US005203053A

United States Patent [19]

Rudd

[11] Patent Number: 5,203,053

[45] Date of Patent: Apr. 20, 1993

[54] SHOE FASTENING DEVICE

[75] Inventor: Lawrence S. Rudd, San Antonio, Tex.

[73] Assignee: I. J. Associates, Inc., San Antonio, Tex.

[21] Appl. No.: 949,566

[22] Filed: Sep. 23, 1992

[51] Int. Cl.[5] ..... A43C 11/00

[52] U.S. Cl. ..... 24/306; 24/442

[58] Field of Search ..... 36/50.1; 224/901; 2/DIG. 6; 24/306, 442, 450, 712, 713, 713.1

[56] References Cited

U.S. PATENT DOCUMENTS

| | | | |
|---|---|---|---|
| 3,526,867 | 9/1970 | Keeler, II | 24/442 X |
| 4,308,672 | 1/1982 | Antonius | 24/306 X |
| 4,901,452 | 2/1990 | Wang | 36/50.1 |
| 4,907,352 | 3/1990 | Ginsberg | 36/50.1 |
| 5,148,614 | 9/1992 | Kelly | 36/50.1 |

*Primary Examiner*—4
*Assistant Examiner*—James R. Brittain
*Attorney, Agent, or Firm*—Charles W. Hanor

[57] ABSTRACT

A shoelace replacing and fastening device comprising an elongated strip, a strip insert and a clasp. Rivet fasteners are used to secure the clasp on one shoe eyelet and to secure the elongated strip to the opposite shoe eyelet of where the clasp is located. The elongated strip is made of a flexible plastic material and has openings for releasably receiving a strip insert at one end of the elongated strip. The strip insert is made of a relatively rigid but flexible plastic material. The elongated strip and the strip insert have a plurality of interlocking hook elements. The hook elements of the strip insert are designed to interlock with the plurality of hook elements of the elongated strip. The clasp is fastened on a shoe eyelet, and the elongated strip fastened on the opposite shoe eyelet to that of where the clasp is fastened. The elongated strip is put through the clasp and the interlocking the hook elements of the strip insert are pressed against the hook elements of the elongated strip to secure a shoe on a foot.

11 Claims, 4 Drawing Sheets

SHOE FASTENING DEVICE

FIELD OF THE INVENTION

The present invention relates generally to footwear, and more particularly to shoe lace replacement devices for replacing conventional shoelaces and for releasably fastening shoes.

BACKGROUND OF THE INVENTION

Shoe lace replacement devices are known in the prior art. Such devices come in various types and styles. A popular shoe lace replacement device uses Velcro material. An example of this is disclosed in U.S. Pat. No. 4,907,352 to Ginsberg. Many other examples of devices for replacing shoelaces have been proposed.

U.S. Pat. No. 4,918,840 to Nardulli discloses a footwear fastener. It uses a zipper as the footwear fastener. The zipper is provided with means to attach the zipper to the shoe eyelet. Such a device has the disadvantage that the user cannot easily tighten or untighten the footwear. Therefore, the user does not have the flexibility of having the footwear as tight or as loose as he wants, at the moment he wants.

U.S. Pat. No. 3,112,545 to Williams shows a different type of shoe fastening device. This device operates very similar to that of a zipper, with the added benefit that it provides for multiple elastic strips with an objective of providing a more comfortable fit. The device, however, does not offer the advantage of tightening or untightening the footwear for desired comfort.

U.S. Pat. No. 4,733,439 to Gentry discloses a fastener for shoes. It consists of multiple elongated flat strips of an elastic material that are attached to the shoe eyelets. This system utilizes mainly plastic material.

U.S. Pat. No. 4,210,983 to Green shows eyelet clamps for shoes. This device substitutes the shoelaces for an apparatus that joins each pair of corresponding eyelets. This system does not provide the flexibility of tightening or untightening the footwear.

Various types of releasable fasteners are also know. Examples of these are as follows.

U.S. Pat. No. 3,557,413 to Engle discloses a plastic, non-mechanical closing and holding device for fastening together materials. Both cross-sections are made of pliable elastic material.

U.S. Pat. No. 3,586,220 to Reinsberg discloses a fastener having two strips made of a resilient and flexible plastic. Both strips are made of the same material.

U.S. Pat. No. 2,940,140 to O'Connor discloses a fastening device that connects overlapping parts. It has two parallel, identically shaped, equidistantly spaced ribs made of plastic. A second set of like ribs are pressed to one another creating a fastening device.

Children, the elderly, handicapped and those with medical problems (i.e. arthritis) may have difficulties when tying their conventional shoe laces. An objective of the present invention is to help eliminate this problem by providing an economical and practical shoe lace replacement and fastening device.

Another objective of the present invention is to provide a simple shoe fastening device that will allow easy tightening and loosening of the shoe while preventing accidental loosening or untying. Another objective of the present invention to allow for an easy way of changing the shoe's appearance such as its color and decoration while maintaining its practicality. The present invention provides for an inexpensive and quick changing of colors and decoration while at the same time maintaining its effectiveness and ease of use.

In accordance with the following description other objectives of the invention will become apparent from the detailed description and drawings.

SUMMARY OF THE INVENTION

A shoe lace replacing and shoe fastening device is provided that comprises a clasp and an elongated strip having a strip insert. The clasp is mounted on the eyelet of the shoe with a rivet. The elongated strip is mounted on the eyelet opposite to the eyelet where the clasp is mounted with a rivet. The strip insert is attached to the elongated strip. The strip insert and the elongated strip have a plurality of mating hook elements. At both ends of the strip insert, there are attaching pins that insert into mating holes in the elongated strip. Once the strip insert is attached to the elongated strip, the elongated strip is put through the clasp and the shoe can be fastened by pressing the mating hook elements together. The elongated strip has a plurality of rectangular openings adjacent to the end of the strap which releasably receive the hook elements of the strip insert. At each side of the rectangular openings are two elongated holds for releasably engaging the attaching pins of the strip insert. The elongated strip is made of flexible thermoplastic material. The strip insert is made of relatively rigid but flexible plastic material. The relatively rigid but flexible hook elements of the strip insert slightly deform or bend the hook elements of the elongated strip when the mating hook elements are pressed together. The two-piece elongated strip and strip insert combination allow mixing and matching of colors.

DESCRIPTION OF THE PREFERRED EMBODIMENT

Figure 1:
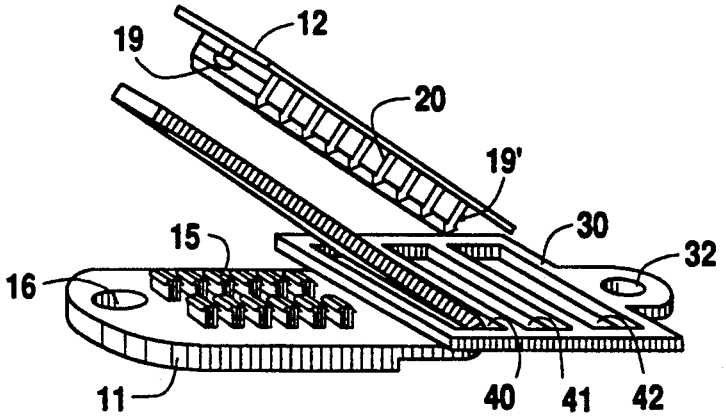
FIG. 1 is an exploded view of the clasp, the strip insert and the elongated strip.
Figure 1A:
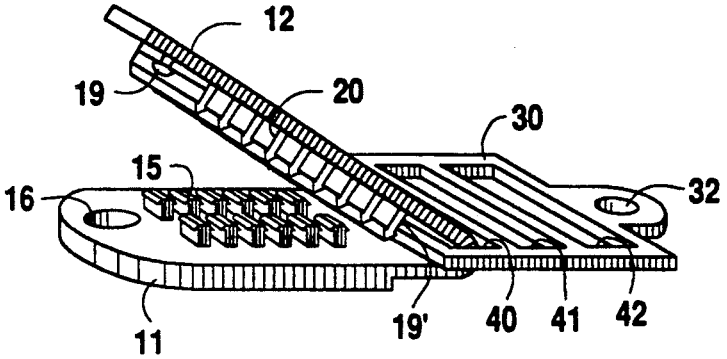
FIG. 1*a* is a perspective view of the clasp showing the strip insert mated to the elongated strip.
Figure 1B:
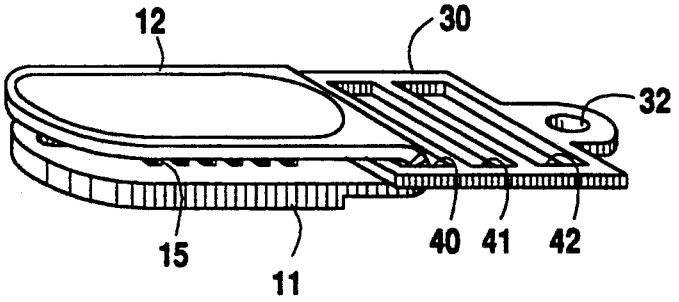
FIG. 1*b* shows the elongated strip and strip insert connected with each other.
Figure 4:
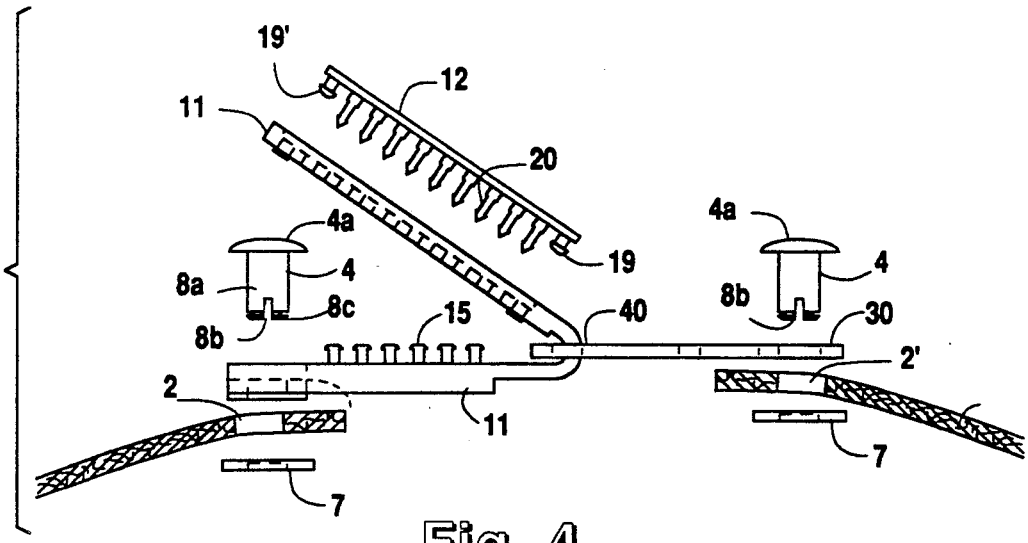
FIG. 4 is a side view of the present invention in position for installing on a shoe.
Figure 5:
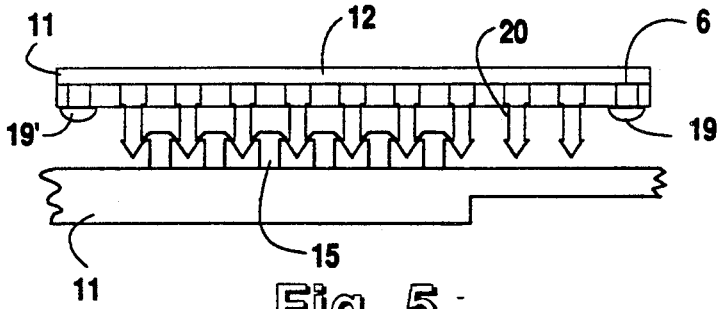
FIG. 5 is a side view which shows how the strip insert is adjustably attached to the elongated strip and how the hook elements of the strip insert lock to the hook elements of the elongated strip.
Figure 5B:
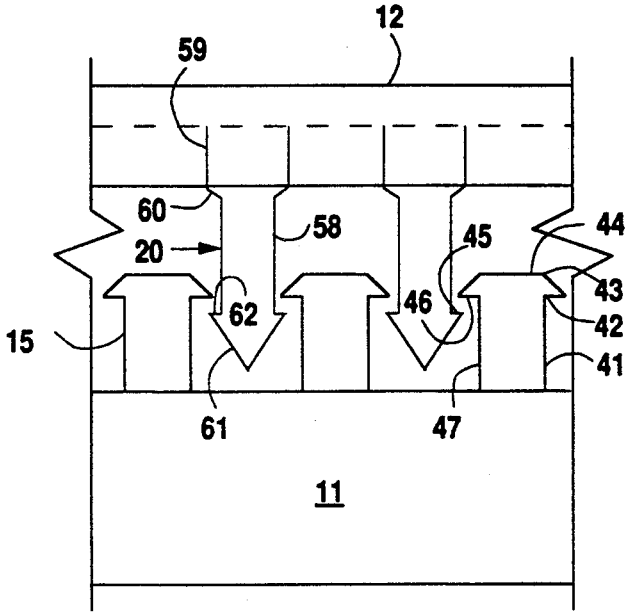
FIG. 5*b* is a partial side view of the hook elements of the strip insert and connected with the mating hooking elements of the elongated strip.
Figure 9:
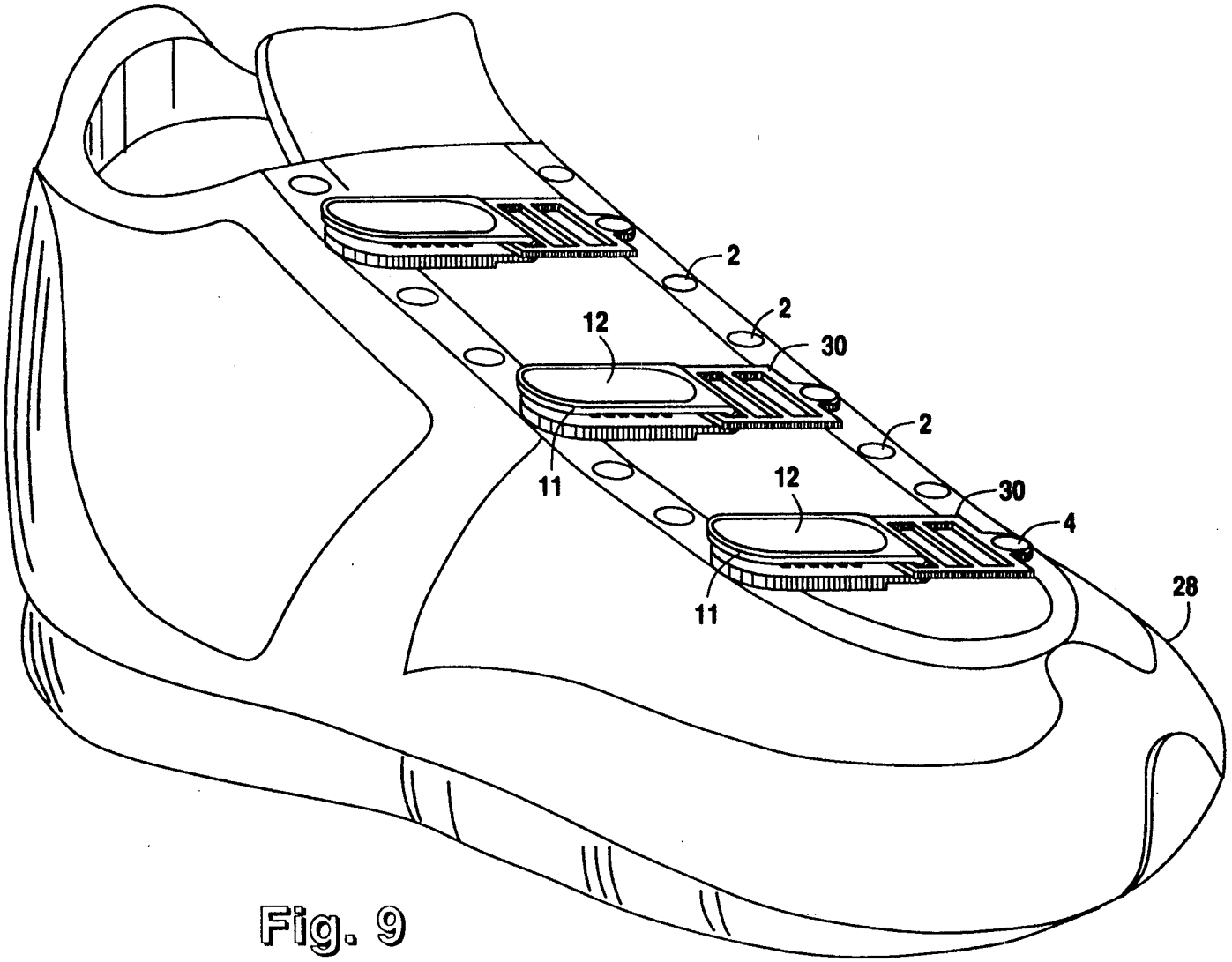
FIG. 9 is a perspective view of a shoe with the shoe replacement and fastening device of the invention.

Referring to FIGS. 1, 1*a* and 1*b*, a shoe fastening and shoe lace replacing device is shown. It includes an elongated strip 11 made of a flexible plastic material. The plastic material of which the elongated strip is made is preferable PVC plastic. The elongated strip 11 has an aperture 16 in one of its ends to secure the elongated strip 11 to a shoe eyelet 2 with a rivet 4 as shown in FIGS. 4 and 9. The rivet 4 is preferably made of DELRON brand plastic. The elongated strip 11 has a plurality of hook or fastening elements 15. A strip insert 12 made of relatively rigid but flexible plastic material is releasably connectable to elongated strip 11. The strip insert 12 is preferable made of LEXAN brand plastic material which is less flexible then PVC plastic so that it is relatively rigid. The strip insert 12 is flexible enough so that it will contour or bend to the shape of the arch of a foot. It is less flexible than the elongated strip so facilitate holding when the hook or fastening elements are pressed together to secure a shoe on a foot. Strip insert 12 has a plurality of hook or fastening elements 20. At each side of the plurality of hook elements 20 are two attachment pins or prongs 19 and 19' having enlarged heads. The plurality of hook elements 15 of the elongated strip 11 are designed to be connected by pressure to the plurality of hook elements 20 of strip insert 12 as shown in FIGS. 5 and **5*b*. The relatively rigid but flexible hook elements 20 deform and bend the flexible hook elements 15 when pressed together. The elongated strip 11 with strip insert 12 can be put through any of the rectangular openings 40, 41 or 42 of clasp 30 to vary the tightness of the shoe on the foot arch. The clasp 30 is preferably made of DELRON brand plastic which is a rigid and relatively hard plastic material. Clasp 30 has an aperture 32 that may be attached by a rivet 4 to a shoe eyelet opposite to a shoe eyelet to which aperture 16 of elongated strip 11** is attached with an identical rivet.

FIG. **1*a* shows the fastening and shoe lace replacing device with the strip insert 12 releasably inserted into elongated strip 11. This is accomplished by inserting hook elements 20 through the elongated strip rectangular openings 13. The strip insert 12 is secured to elongated strip 11 by inserting pins or prongs 19 and 19'0 of strip insert 12 through the elongated strip holes 6 and 6' shown in FIG. 2. The pins 19 and 19' are relatively rigid but flexible so they can slightly deform or bend the areas of the holes 6 and 6' during insertion. Clasp 30 has an aperture 32 for receiving the fastening rivet device 4 (shown in FIGS. 3 and 4) to attach the clasp to a shoe eyelet 2 as shown in FIGS. 4 and 9. FIG. 1*b* shows the elongated strip 11 and strip insert 12** secured to each other.

Figure 2:
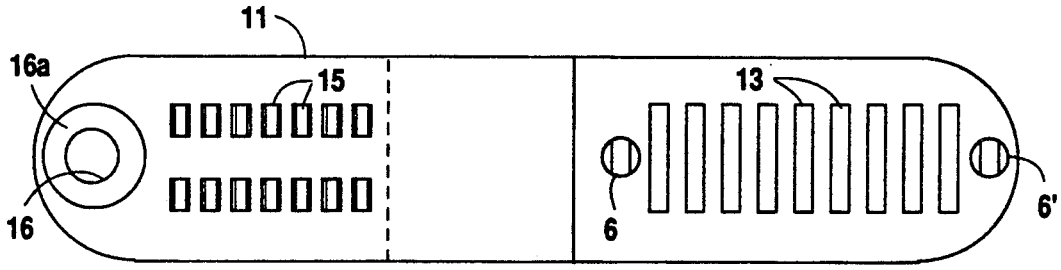
FIG. 2 is a top view of the elongated strip.

FIG. 2 shows a top view of the elongated strip 11. Elongated strip 11 has an enlarged recess portion 16 for receiving the fastening rivet device 4. Enlarged recess portion 16 allows the head **4*a* of rivet 4 to be recessed flush with the top surface of strip 11. Elongated strip 11 has a plurality of hook elements 15 at one end. At the opposite end is a recessed cavity portion 11*a* with rectangular openings 13 for releasably receiving hook elements 20 of the strip insert 12. The strip insert 12 is generally flush with the top of elongated strip 12 when they are mated together. At opposite sides of the series of rectangular openings 13 are oval openings 6 and 6' for releasably receiving pins or prongs 19 and 19' of strip insert 12**.

Figure 3:
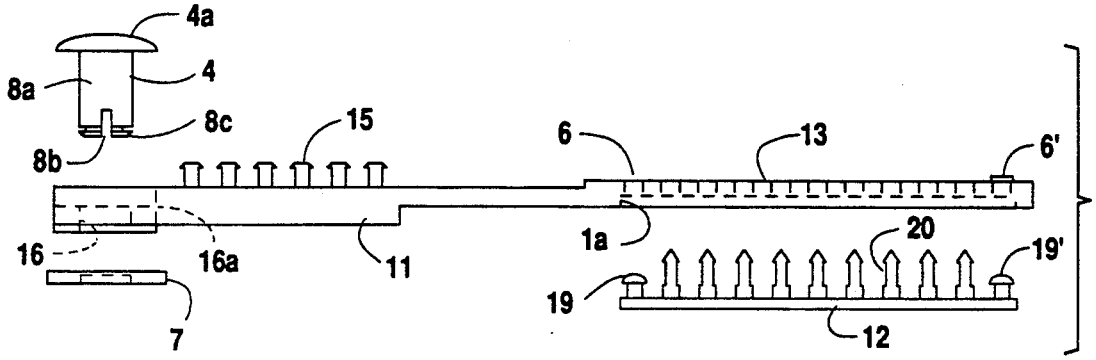
FIG. 3 is a side view of the elongated strip, the strip insert and the securing device.

FIG. 3 shows an exploded side view of securing rivet means 4, elongated strip 11 and strip insert 12. Fastening rivet means 4 has an oval head **4*a* and a cylindrical post 8*a*. Post 8*a* has a small groove or channel 8*b* and round portion 8*c* opposite head 4*a*. Rivet 4 is inserted through aperture 16 with head 4*a* in recess 16*a*. The opening in the washer fastener 7 receives enlarged round portion 8*c*** to connect the rivet to a shoe eyelet.

FIG. 4 shows an exploded side view. The flexible elongated strip 11 is inserted through opening 40 of clasp 30. The elongated strip 11 and clasp 30 are shown in position for fastening to shoe eyelets 2 and 2' with the fastening devices 4. One rivet fastening device 4 is inserted through aperture 32 of clasp 30 and the other identical fastening rivet device 4 is inserted through aperture 16 of elongated strip 11. Each fastening rivet device 4 is releasably inserted in opposed shoe eyelet members.

FIG. 5 shows the hook elements 20 of the strip insert 12 connected to the hook elements 15 of the elongated strip 11. Strip insert 12 is made of a relatively rigid but flexible plastic material. The elongated strip 11 is made of a relatively flexible plastic material so their mating hook elements can be attached to one another by applying pressure. The hook elements 20 of the strip insert 12 can bend or deform the hook elements 15 of the elongated strip 11 because they are made of a flexible plastic material. This allows the mating hook elements to be easily and quickly released and reconnected as desired.

The hook elements 20 of strip insert 12 are shown enlarged in FIG. **5*b*. The hook elements 15 of strip insert 12 have a base 58 with an enlarged base portion 59. Each enlarged portion 59 can be slightly larger than each rectangular opening 15 in strip insert 12 to provide a tight fit. The enlarged portion 59 has a relief portion 60. An enlarged head portion 61 having a triangular cross-section is formed at the end of base 58. The hook elements 15 of elongated strip 11 have base 41. At the end of base 41 is an enlarged head portion 42 having a trapezoidal cross-section. The end 43 of head portion 42 has a flat surface 44. When pressure is applied between hook elements 20 of strip insert 12 and hook elements 15 of elongated strip 11, hook elements 15 of elongated strip 11 will deform and bend upon mating with hook elements 20 of strip insert 12. This allows for enlarged head portion 61 of hook elements 20 of strip insert 12 to pass between adjacent head portions 43 of hook elements 15 of elongated strip 11. This releasably interlocks strip insert 12 with elongated strip 11 as shown in FIGS. 5 and 5*a*. This provides for adjustability by allowing someone to select where the hook elements 20 are mated with the hook elements 15. The elongated strip 11 can be the same color as strip insert 12 and can be another color. This allows a user to decorate their shoes by selecting desired colors. The washers 7 are releasable from the rivets 4** to permit interchanging of sets of fasteners.

Figure 6:
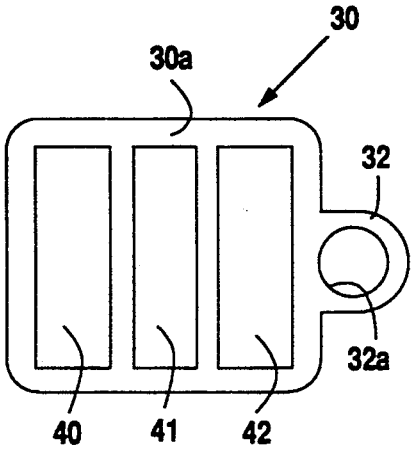
FIG. 6 shows one embodiment of the clasp with three (3) apertures for the elongated strip.

FIG. 6 shows a top view of clasp 30. Clasp 30 has hole **32*a* for receiving rivet 4. FIG. 6 shows one embodiment of clasp 30. Clasp 30 comprises of flat member 30*a*. Member 30*a* has apertures 40, 41 and 42 for selectively receiving the elongated strip 11. At one end of the apertures there is an tab extension 32. The tab extension 32 has hole 32*a* to releasably receive fastening rivet device 4**.

Figure 7:
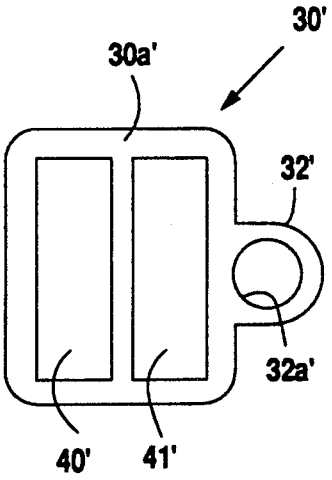
FIG. 7 shows another embodiment of the clasp with two (2) apertures for the elongated strip.

FIG. 7 shows another embodiment with clasp 30' having a flat member **30*a* with two apertures 40 and 41. At one end of member 30' there is tab extension 32'. Tab extension 32' has hole 32*a'* for releasably receiving fastening rivet device 4**.

Figure 8:
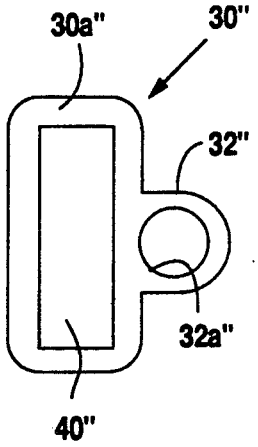
FIG. 8 shows another embodiment of the clasp with one (1) aperture for the elongated strip.

FIG. 8 shows another embodiment with clasp 30'' with flat member **30*a''* and only one aperture 40''. At one side of member 30***a*″ is tab extension 32″ with hole 32*a*″.

By selecting either clasps 30, 30′ or 30″ a user can make the hook elements 15 and 20 mate in their optimal locations. This allows the shoe lace device of the invention to be used on various sized shoes. A single kit including all three clasps will allow replacing the shoe laces on many varying sized shoes.

FIG. 9 shows a perspective view of a shoe with shoelace replacement and fastening devices of the invention in place of conventional shoelaces. Although three devices are shown, it is understood that one or devices can be used depending on the size and type of shoe. It is apparent that the hook elements 20 of strip insert 12 can be quickly and easily disengaged from hook elements 15 of elongated strip 11 by lifting up on one end of strip insert 11. The hook elements can be reconnected at mating locations to provide a desired tightness. The elongated strip 11 can be inserted through a selected hole on one of the openings of the clasp to provide a desired tightness.

Although the present invention has been described in terms of the foregoing preferred embodiments, this description has been provided by way of explanation only and is not to be construed as a limitation of the invention, the scope of which is limited only by the following claims.

What is claimed is:

1. A shoe lace replacing and fastening apparatus comprising:

a clasp for mounting on one side of a shoe;

an elongated flexible strip for mounting on an opposite side of a shoe and having a plurality of hook elements at one end and a plurality of openings at the opposite end of the strip; and a strip insert having a plurality of hook elements for releasably inserting into the plurality of openings and for releasably mating and connecting with the hook elements on the elongated strip when pressed together to secure a shoe onto a foot.

2. The shoe lace replacing and fastening device as in claim 1, wherein:

the elongated strip is made of a flexible and deformable plastic material.

3. The shoe lace replacing and fastening device as in claim 1, wherein:

the strip insert is made of a relatively rigid but flexible plastic material.

4. The shoe lace replacing and fastening device as in claim 1, wherein:

the elongated strip is made of a flexible plastic material and the strip insert is made of a relatively rigid but flexible plastic material.

5. The shoe lace replacing and fastening device as in claim 1, wherein:

the clasp has a plurality of openings for the elongated strip to go through.

6. The shoe lace replacing and fastening device as in claim 1, including:

releasable rivets for releasably mounting the clasp and elongated strip on a shoe.

7. The shoe lace replacing and fastening device as in claim 1, wherein:

the hook elements of the strip insert have a triangular cross-section.

8. The shoe lace replacing and fastening device as in claim 1, wherein:

the hook elements of the elongated strip have a trapezoidal cross-section.

9. The shoe lace replacing and fastening device as in claim 1, wherein:

the hook elements of the strip insert have a triangular cross-section and the hook elements of the elongated strip have a trapezoidal cross-section.

10. The shoe lace replacing and fastening device as in claim 1, wherein:

the elongated strip has a recess and the strip insert fits within the recess so the top of the strip insert is generally flush with the top of the elongated strip.

11. The shoe lace replacing and fastening device as in claim 1, wherein:

the elongated strip is of a different color material that the strip insert.

* * * * *